US007219378B2

(12) United States Patent
Polevoy et al.

(10) Patent No.: US 7,219,378 B2
(45) Date of Patent: May 22, 2007

(54) SUPPORT MEMBER FOR A BED FRAME

(75) Inventors: Richard S. Polevoy, Teaneck, NJ (US); Paul Eric Carlson, Skaneateles, NY (US); Howard Scott Ryan, Skaneateles, NY (US)

(73) Assignee: Finger Lakes Intellectual Property, LLC, Teaneck, NJ (US)

( * ) Notice: Subject to any disclaimer, the term of this patent is extended or adjusted under 35 U.S.C. 154(b) by 0 days.

(21) Appl. No.: 11/129,025

(22) Filed: May 13, 2005

(65) Prior Publication Data

US 2005/0278849 A1 Dec. 22, 2005

Related U.S. Application Data

(60) Provisional application No. 60/570,700, filed on May 14, 2004.

(51) Int. Cl.
*A47C 19/02* (2006.01)

(52) U.S. Cl. ..... 5/200.1; 5/201; 5/207; 5/310; 5/282.1

(58) Field of Classification Search ..... 5/200.1, 5/201–203, 207–209, 238, 305, 282.1, 286, 5/310, 311
See application file for complete search history.

(56) References Cited

U.S. PATENT DOCUMENTS

| | | | | | |
|---|---|---|---|---|---|
| 3,761,971 | A * | 10/1973 | Behnke | 5/201 |
| 3,828,376 | A * | 8/1974 | Miller | 5/200.1 |
| 4,195,377 | A * | 4/1980 | Kitchen et al. | 5/310 |
| 4,745,644 | A * | 5/1988 | Pottschmidt | 5/200.1 |
| 5,477,571 | A * | 12/1995 | Roggenkamp et al. | 5/310 |
| 6,125,484 | A * | 10/2000 | Thomson | 5/200.1 |
| 6,851,140 | B2 * | 2/2005 | Polevoy et al. | 5/200.1 |

* cited by examiner

*Primary Examiner*—Michael Trettel
(74) *Attorney, Agent, or Firm*—Klauber & Jackson

(57) ABSTRACT

A T-shaped support member that can be used with a bed frame or bed rails to provide support for a box spring and mattress. A leg assembly is affixed to the support member and is used to support the cross member. The leg assembly includes a housing having a leg that extends downwardly from the support member to contact the floor on which the bed frame or bed rails are located. The length the leg is extendable from the support member is self adjusting by a mechanism that can be twisted to an unlocked position to drop the leg downwardly quickly to contact the floor and then twisted back to lock the leg in that extended length.

30 Claims, 10 Drawing Sheets

SUPPORT MEMBER FOR A BED FRAME

CROSS-REFERENCE TO RELATED APPLICATIONS

The present application is based upon U.S. Provisional patent application No. 60/570,700, filed May 14, 2004 and entitled "SUPPORT MEMBER FOR A BEDFRAME".

BACKGROUND OF THE INVENTION

The present invention relates to bed frames, and, more particularly, to a support member that spans and thus interconnects the side rails of a bed frame.

In general, bed frames are comprised of a pair of generally parallel, spaced apart, side rails and one or more cross support members that span between the side rails in order to assemble and complete the bed frame structure. The bed frame, once assembled is adapted to support a box spring and a mattress to make up the bed itself.

Conventionally, with a bed frame, the side rails can be metal angle irons or wooden side rails and the cross or support members can be wooden slats or can be other structural components such as angle irons that are L-shaped and which have legs that extends downwardly from the angle irons to contact the floor in order to support the weight imposed on the support members by the presence of the box spring, mattress and, of course, an individual or individuals sleeping in the completed bed.

One of the difficulties, however, with the use of an L-shaped angle iron as the cross or support member is that the cross sectional profile of the L-shaped angle iron renders the member susceptible to a bending weakness, that is, for example, when the bed is slid along the floor, the leg supporting the support member and being dragged across the underlying floor can cause the support member to twist and the twisting action can damage an L-shaped angle iron support member that is not particularly resistant to such twisting action.

In addition, there is a bending action that is created by a downward force on the surface of an L-shaped support member tending to turn the L-shape into a downward V-shape and continued downward force tends to try to flatten that V-shape. Basically, the L-shape angle iron will twist away from the vertical flange, that is, the distal end of the horizontal flange will twist away from the vertical flange in the downward direction by the load imposed on the L-shaped angle iron. Thus, the problem with the use of an L-shaped angle iron is not limited to the possible bending caused by the leg being twisted by encountering a snag in a carpet as the leg extending downwardly from an L-shaped support member is moved across that carpet but also simply by the weight of the load imposed on the angle iron support member tending to twist that angle iron.

As a further problem, the conventional legs that extend downwardly from the angle iron support members are sometimes difficult to adjust to achieve the proper height of the support member from the floor. If the height of the leg is too long, the support member will bow upwardly and, if too short, the support member will bow downwardly. As such, it is important for the user to set the height of the leg correctly so that the support member is located at the proper height from the floor and it is also important to make that height adjustment easy to carry out by the user. With some current adjustable legs, the leg is threaded to a leg bracket such that the assembler must unscrew the leg to reach the desired length to contact the floor. There is a problem, however, as the unscrewing of the threaded leg is fairly time consuming to reach the desired position and there is no clear indication when the proper length o the leg has been reached and the threaded leg can be extended too far or not far enough for the proper support of the support member.

Also, the length of the support member must be adjustable so that the support member can be readily installed, for example, between wooden side rails, and be easy to affix the ends of the support member to those wooden side rails. For a wooden support member the solution is to simply saw the support member to the correct length, however there is an advantage in having a metal support member to eliminate the sawing process and the saw such that it is advantageous to have some adjustment system to allow the assembler to adjust the length of a metal support member to accommodate the varied widths between side rails.

It thus would be advantageous to have a support member for a bed frame that would be inexpensive to produce and yet which is sufficiently strong so as to resist twisting forces while supporting the box spring and mattress. In addition, it would be advantageous to have a leg assembly affixed to the support member that can be easily adjusted to achieve the proper height of the leg assembly to provide support to that support member by means of contact with the floor. It would be further advantageous if the support member had a length adjustment to allow it to be the proper length so as to be dimensionally affixed between two parallel side rails.

SUMMARY OF THE INVENTION

Now, in accordance with the present invention, there is provided a support member for attachment between parallel side rails in constructing a bed frame.

The support member includes a substantially straight member that is specially configured to have a T-shaped cross section with the flat upper surface of the T-shape having the box spring and mattress resting thereon and with the intermediate vertical flange extending downwardly therefrom. The downwardly extending flange is, of course, perpendicular to the upper flat surface of the T shaped support member.

The use of a T-shaped support member greatly improves the twist resistance of the support member and therefore reduces the potential of damaging bending of that support member over the normal L-shaped angle iron cross section. Thus, a twisting force imposed by a load on either of the distal ends of the horizontal flanges is resisted by the other distal end such that there is less likelihood of a downward deflection of either distal end of the horizontal flange, thereby, providing a resistance to the twisting of the support member under load.

There is also a leg assembly that is affixed to the support member, generally intermediate its ends or basically located midway between the parallel side rails. The leg assembly extends downwardly from the support member in order to make contact with the floor on which the bed frame of bed rails are located and comprises a housing, preferably constructed of a plastic material and a leg that extends downwardly from that housing to actually contact the floor. The leg is also preferably constructed of a plastic material.

Since the actual length that the leg extends from the housing is an important dimension and must be carefully controlled to avoid a bowing upwardly or downwardly of the support member, there is, in an embodiment of the present invention, a mechanism that allows the leg to self adjust for the correct length, that is, there is a mechanism that has an unlocked position where the leg is free to move axially with respect to the housing and can, in that position fall by gravity, or be pulled downwardly, to the floor contacting length and the mechanism then allows the user to place the mechanism into a locked position where the leg is locked into a particular extended length.

In the embodiment shown, the locking and unlocking is carried out by a twisting motion such that in one position, the leg is in the unlocked position and the leg can be simply twisted a predetermined amount in order to place it in the locked position. That twisting action also serves to extend the leg a slight amount to assure that the leg is in good solid contact with the floor in supporting the support member. Thus, the length the leg is extended from the housing and, therefore, from the support member, can readily be arrived at by allowing the leg to drop by gravity and then just as readily be locked into that particular length.

Other features of the present support member and leg assembly combined therewith will become more apparent in light of the following detailed description of a preferred embodiment thereof and as illustrated in the accompanying drawings.

DETAILED DESCRIPTION OF THE INVENTION

Figure 1:
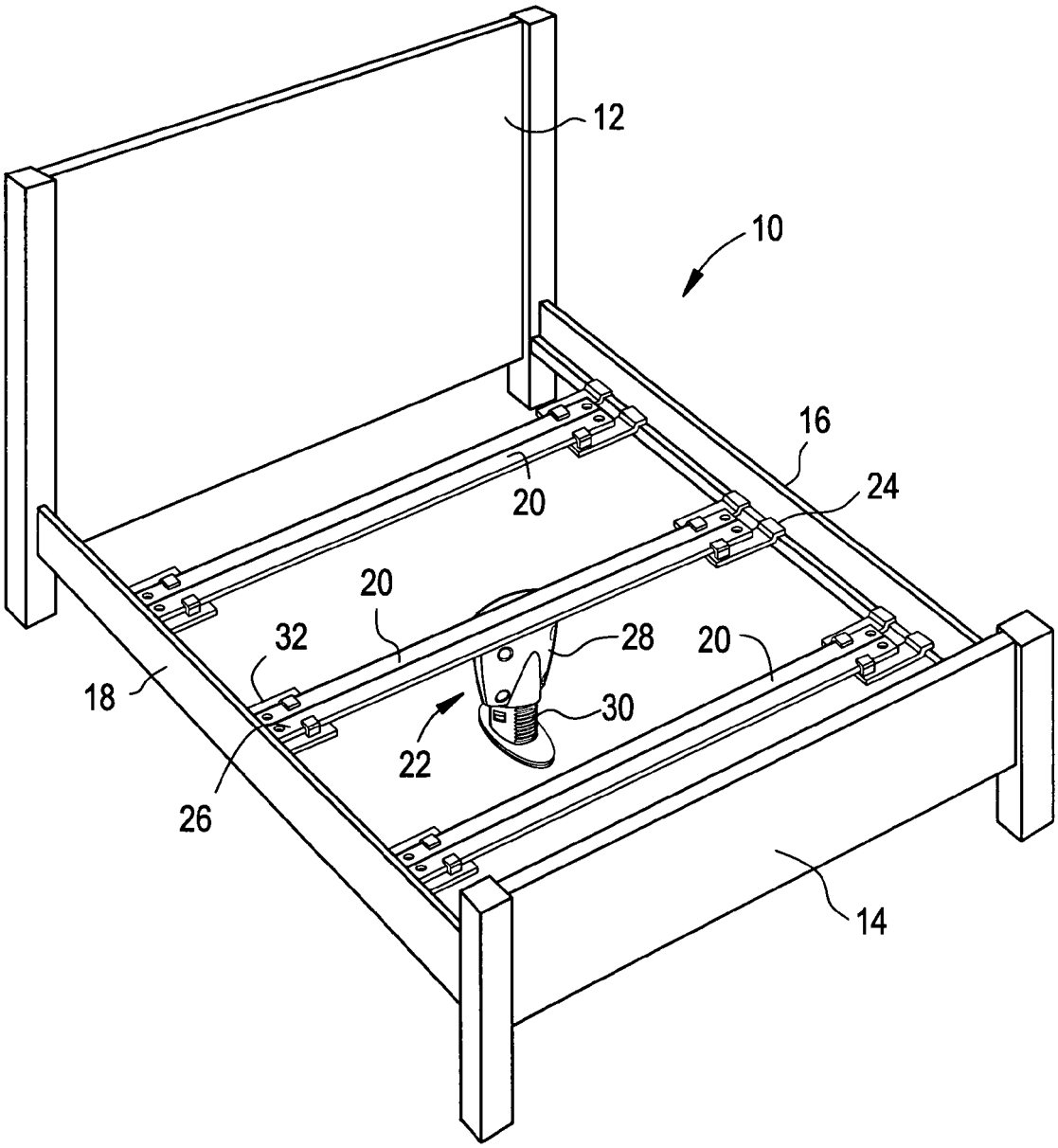
FIG. 1 is a perspective view of a completed bed frame utilizing support members constructed in accordance with the present invention.

Referring now to FIG. 1, there is shown a perspective view of a bed frame 10 and which includes a head board 12, a footboard 14 and two parallel side rails 16, 18 both of which are shown to be wooden side rails. A bed frame 10 is used for illustrative purposes, it being seen that bed rails could also make use of the present invention. To make up the bed frame 10, there are also support members 20 that span between the parallel side rails 16, 18 and are affixed thereto. Leg assemblies 22, only one of which is shown, are affixed to the support member 20, generally about midway between the side rails 16, 18, or, alternatively, between the ends 24, 26 of the support member 20. The leg assembly 22 shown, is affixed to the support member 20 and extends downwardly therefrom to contact the underlying floor on which the bed frame 10 rests in order that the floor provide the necessary support for the support member 20. That support is, of course, necessary inasmuch as the support members 20 are the supporting members for the box spring and mattress when the final bed is assembled for use.

The leg assembly 22 comprises a housing 28 and a leg 30 that extends downwardly from the housing 28 and the leg 30 actually makes the contact with the floor. As also can be seen in FIG. 1, there are telescoping brackets 32 located at each of the ends 24, 26 of the support members 20 and which will be later described in detail.

Figure 2:
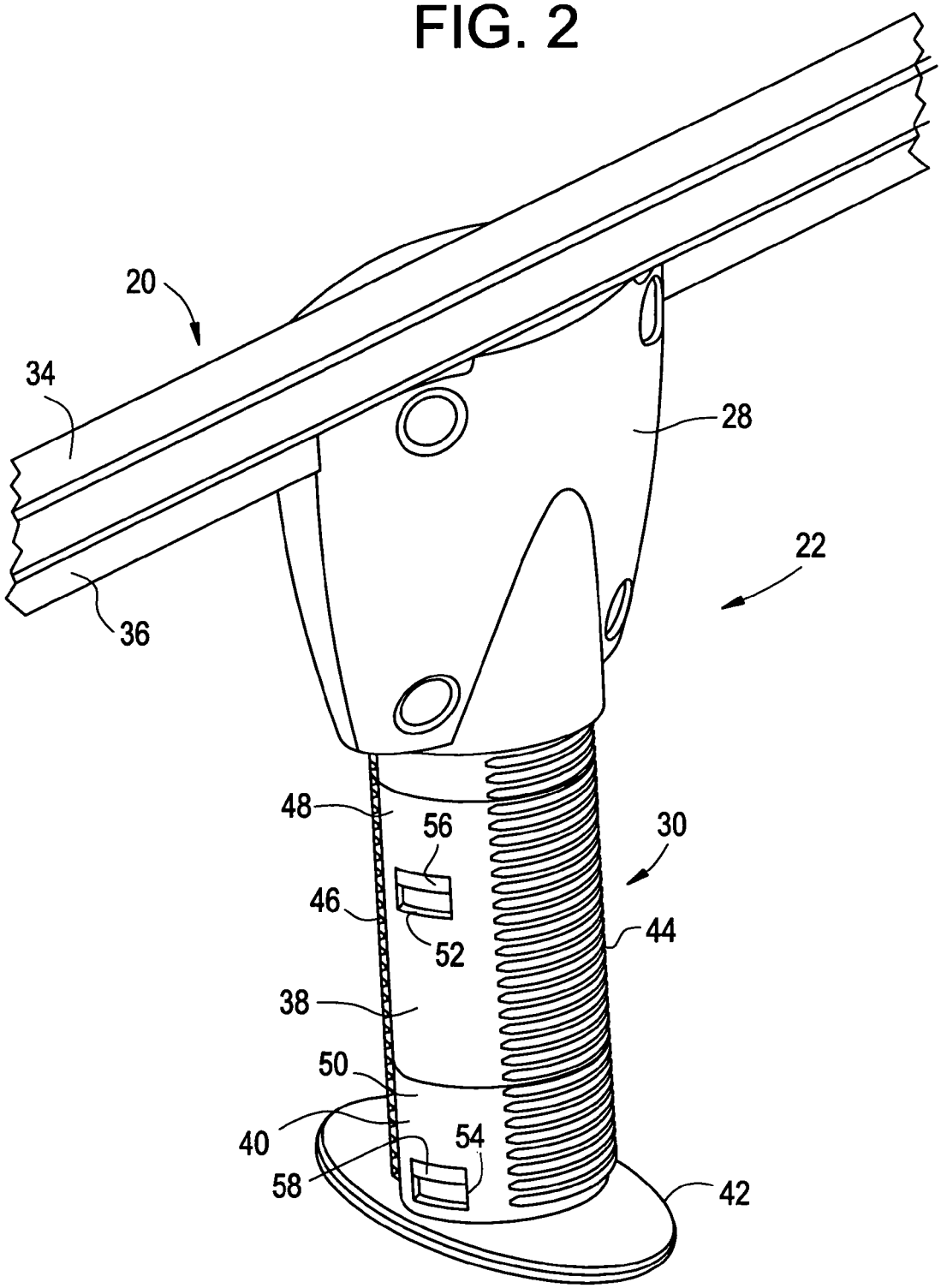
FIG. 2 is a perspective view of a support member and leg assembly of the present invention.

Turning now to FIG. 2, there is shown a perspective view of a leg assembly 22 constructed in accordance with the present invention. The support member 20 is a substantially straight member and can be seen to have a T-shaped cross section with a flat, upper surface 34 upon which rests the box spring and mattress upon the completion of assembly of a bed and a vertical flange 36 that extends downwardly from the flat, upper surface 34 and located generally at the midpoint of the bottom of that flat, upper surface 34. In the construction of the support member 20, the T-shaped cross section profile can be achieved by the joining together of two L-shaped angle irons, such as by welding or riveting or, alternatively, the T-shaped support member 20 can be originally rolled as a one piece T-shaped member.

The housing 28 is affixed to the support member 20 and the leg 30 extends downwardly therefrom. As will be seen, the leg 30 is comprised of a leg section 38 and there may be a plurality of such leg sections 38 in order to arrive at the correct length of a leg 30 since the vertical height from the floor of any support member 20 is determined by the particular bed frame construction and a particular support member 20 may vary considerably in its distance or height from the floor. The bottom leg section 40 also has a glide 42 that actually contacts the floor and that glide 42, in the embodiment shown, is oblong or oval shaped with its widest axis generally shown to be at a right angle with respect to the longitudinal axis of the support member 20 and, as will be seen, in this orientation of the glide 42, the leg 30 is in a locked position with respect to the housing 28 and is rigidly affixed within the housing 28 so as to be vertically movable with respect to that housing 28.

There are also sets of outstanding grooves 44, 46 formed on the exterior of the leg section 38 and the bottom leg section 40 and those grooves are centered about 180 degrees apart and each set of grooves spans a little less than 90 degrees about the circular periphery of the leg section 38 and the bottom leg section 40. In the embodiment shown, the center points of the sets of grooves 44, 46 are oriented such that a centerline between the centers of the sets of grooves 44, 46 is at a right angle to the longitudinal axis of the support member 20. In the embodiment shown, the outstanding grooves 44, 46 are basically rectangular or squared in cross sectional configuration.

The remaining peripheral area of the exterior of the leg section 38 and the bottom leg section 40 are smooth areas 48, 50, respectively, and there are also corresponding smooth areas on the leg section 38 and bottom leg section 40 facing away from the smooth area 48, 50 shown in FIG. 2. Each of the smooth areas 48, 50 have openings 52, 54 and there are flexible tabs 56, 58 snapped into each of the openings 52, 54 which will also be later explained.

Figure 3:
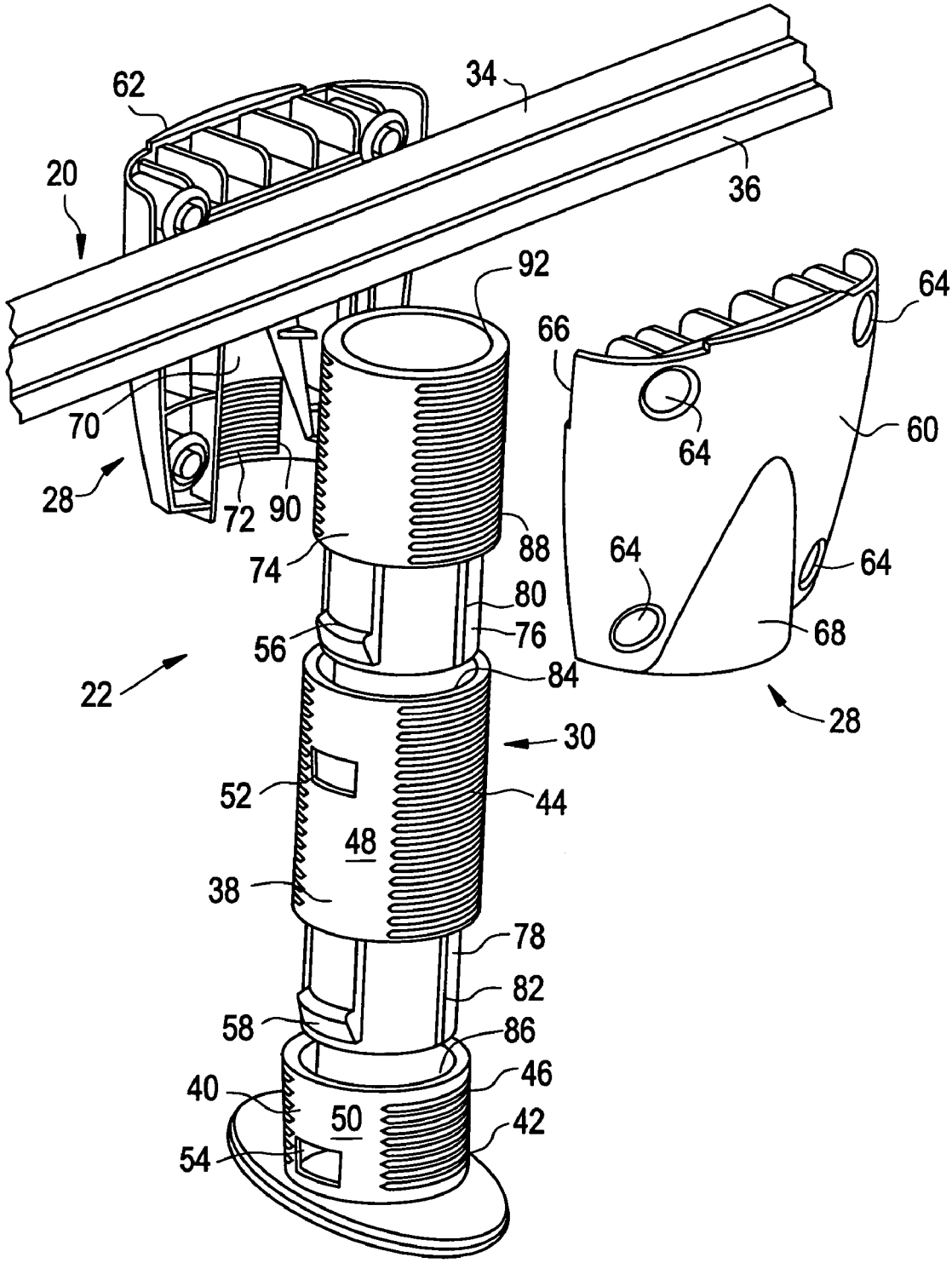
FIG. 3 is an exploded view of a leg assembly of FIG. 2.

Turning now to FIG. 3, there is shown an exploded view of the leg assembly 22 and illustrating its assembly and affixation to the support member 20. Accordingly, the housing 28 can be seen to be comprised of first and second housing sections 60, 62 that are affixed together about opposite sides of the vertical flange 36 by means such as rivets or bolts, not shown, passing through openings 64 formed in the first and second housings 60, 62. As such, the first housing section 60 has an indentation 66 to interfit tightly to the vertical flange 36 of the support member 20. Similar indentations are provided on the far side of the first housing section 60 as well as two such indentations formed on the second housing section 62. The rivets or bolts the pass through the upper of the openings 64 also pass through holes, not shown in the vertical flange 36 in affixing the leg assembly 22 to the support member 20.

Both of the first and second housing sections 60, 62 have flared out sections 68, 70, respectively, and within the interior of the flared out sections 68, 70 are formed outstanding grooves 72. Again, only the grooves on the second housing section 62 are shown, however, there are corresponding outstanding grooves formed in the interior of the flared out section 68 of the first housing section 60. The outstanding grooves formed in the interior of the first and second housing sections 60, 62 are centered 180 degrees apart and traverse a little less than 90 degrees around the circular internal surface of the first and second housings 60, 62.

The leg assembly 22 shown in FIG. 3 comprises a plurality of leg sections, that is, there is a bottom leg section 40, a leg section 38 and an upper leg section 74. There can, of course be more than one leg section 38 located between the upper leg section 74 and the bottom leg section 40 in constructing a leg assembly 22. The various leg sections interfit with each other in a telescoping fashion since there is a lower flange 76 that extends downwardly from the upper leg section 74 that enters the leg section 38 and, likewise, there is a lower flange 78 that extends downwardly from the leg section 38 that enters the bottom leg section 40.

Each of the lower flanges 76, 78 includes a vertical protuberance 80, 82 respectively, that interfits into a vertical slot 84, 86 provided on the interior surface of the leg section 38 and the bottom leg section 40, respectively, so that the intermitting of the upper leg section 74 into the leg section 38 and the interfitting of the leg section 38 into the bottom leg section 40 provide an alignment of the sections. That alignment is necessary in order to also align the flexible tabs 56, 58 with the openings 52, 54 as the upper leg section 40 and the leg section 38 are snapped into the intermitting relationship with respectively the leg section 38 in the bottom leg section 40.

Thus, in assembling the leg assembly 22, for example, the leg section 38 is snapped into the bottom leg section 40 so that the flexible tab 56 on the leg section 38 snaps through the opening 54 and in a similar manner, the upper leg section 74 is snapped on to the leg section 38. By the use of the separate assembly of the various leg sections, the height of the overall leg assembly 22 can be established by the user depending upon the height of the support member 20 above the floor. As can be understood, there may be a greater or lesser number of leg sections used depending on the height of the support member 20 with respect to the floor.

As can now be seen, in the position of the leg 30 as shown in FIG. 3, the set of groves 88 of the upper leg section 74 mesh with the outstanding groves 72 formed in the interior of the second housing section 62 and, as described, also with corresponding outstanding groves in the interior of the first housing section 60 and that meshing prevents the vertical movement of the leg 30, thus when the leg is oriented as shown in FIG. 3, it is in a locked position and its vertical movement with respect to the housing 28 as well as the support member 20 is arrested. It should be noted that in the locked position of FIG. 3, the glide 42 has its major axis at a right angle to the support member 20 so that the user knows by simply looking at the orientation of the glide 42 that the leg 30 is in the locked position.

As such, the leg 30 can be moved from that locked position to an unlocked position by simply rotating the leg 30 about 90 degrees, or a quarter of a turn such that the outstanding groves 72 become aligned with the smooth area 90 of the upper leg section 74. At that position, the leg 30 can be moved vertically with respect to the housing 28 since the groves 88 and the grooves 72 are not meshed and the leg 30 can drop by gravity to contact the floor or can be pulled downwardly by the user.

Accordingly, by rotating the leg 30 a quarter of a turn, it can be moved between its locked and its unlocked position. There is a vertical wall 90 located at one end of the outstanding grooves 72 in both the first and second leg housings 60, 62 to prevent the over rotation of the leg 30 more than the quarter of a turn so that the leg 30 can only be turned in one direction to its locked position and in the reverse direction to its unlocked position. As a further feature of the aforesaid locking mechanism, there is an upper peripheral circular rim 92 at the top of the upper leg portion 74 to serve a purpose to be later described.

Figure 4A:
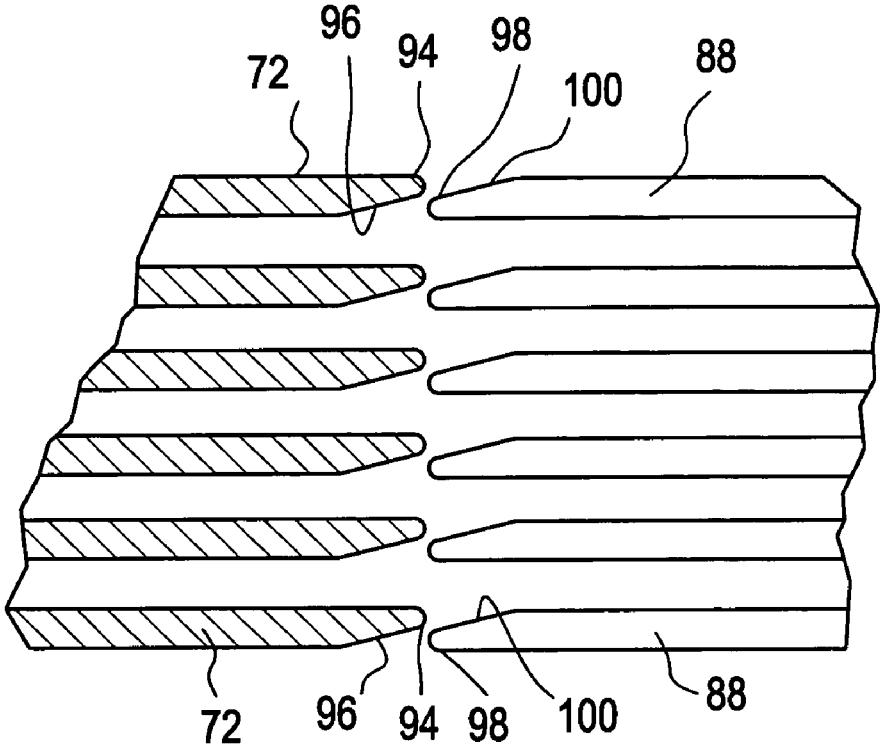
FIGS. 4A and 4B are cross sectional views of the alignment and subsequent meshing of the outstanding grooves of the leg assembly of the invention.
Figure 4B:
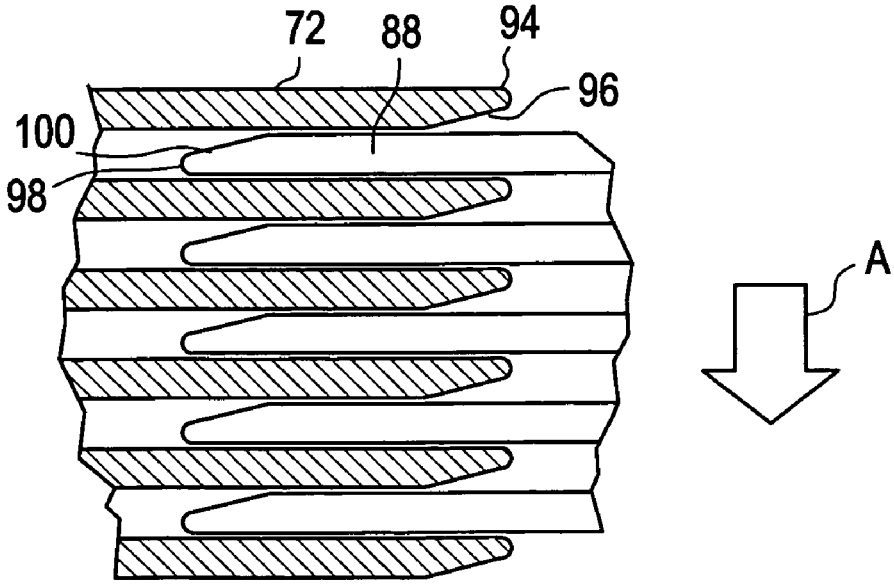

Turning to FIGS. 4A and 4B, taken along with FIG. 3, there are cross sectional views of the alignment and subsequent meshing of the outstanding grooves 88 of, for example, the upper leg section 74 with the outstanding grooves 72 of the housing 28. As can be seen, when the leg 30 is rotated, as previously described, the outstanding grooves 88 of the upper section 70 near the outstanding grooves 72 of the housing 28 and that exact alignment is dependent upon how far the leg 30 has been extended downwardly to contact the floor from the housing 28. The subsequent meshing of the respective groves 88, 72 as the leg 30 is rotated bring about the locked position of the leg 30 with respect to the housing 28 to lock the leg 30 in its extended position contacting the floor. As an added feature, however, the distal ends 94 of the outstanding grooves 72 have a lower surface 96 that slants upwardly whereas the distal ends 98 of the outstanding grooves 88 of the leg 30 have an upper surface 100 that slants downwardly.

Accordingly, as the outstanding grooves 88 of the leg 30 are rotated into the locked position of FIG. 4B, since the outstanding grooves 72 are fixed within the housing 28, the meshing between the distal ends 94 and 98 causes the engagement of the lower surface 96 and upper surface 100 such that any actual displacement of the leg 30 with respect to the housing 28 will always be slightly downwardly in the direction of the arrow A. As such as the leg 30 is rotated into its locked position, the leg 30 will move downwardly, if at all, to better engage the floor and support the support member 20.

Figure 5A:
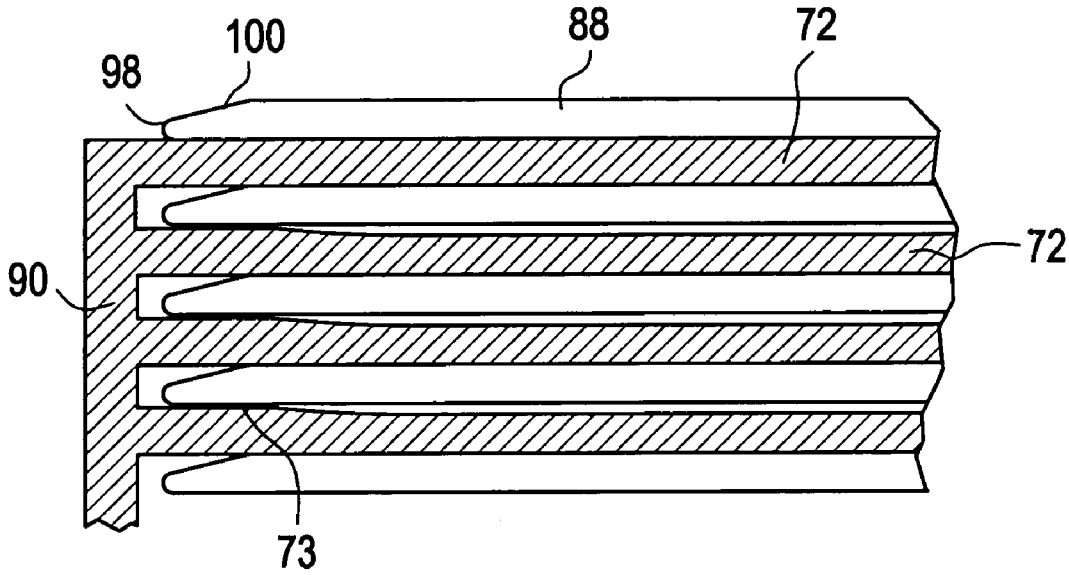
FIGS. 5A and 5B are cross sectional views of the further progress of the meshing of the outstanding grooves of FIGS. 4A and 4B.
Figure 5B:
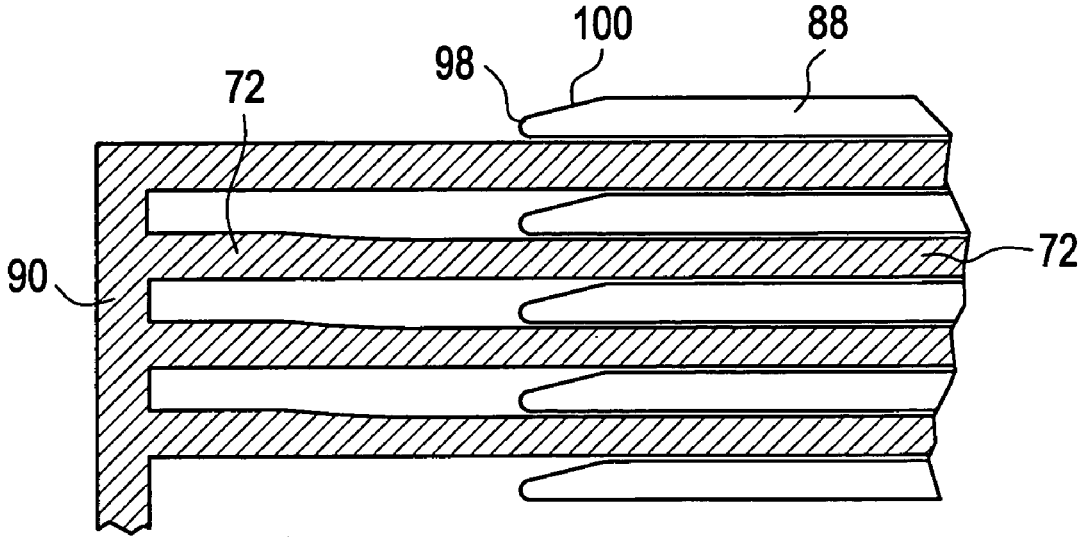

Turning briefly to FIGS. 5A and 5B, the further progress of the meshing of the outstanding grooves 88 into the outstanding grooves 72 of the housing 28 illustrates that the grooves 72 narrow, at 73, as they approach the vertical wall 90 so that, as the rotation of the leg 30 reaches its full locked position there is a slight binding between the outstanding grooves 72 and 88 to assist in retaining the leg 30 in its locked position so that the leg 30 does not easily become inadvertently rotated back to its unlocked position but requires a positive rotational force supplied by the user.

Figures 6A, 6B, 6C:
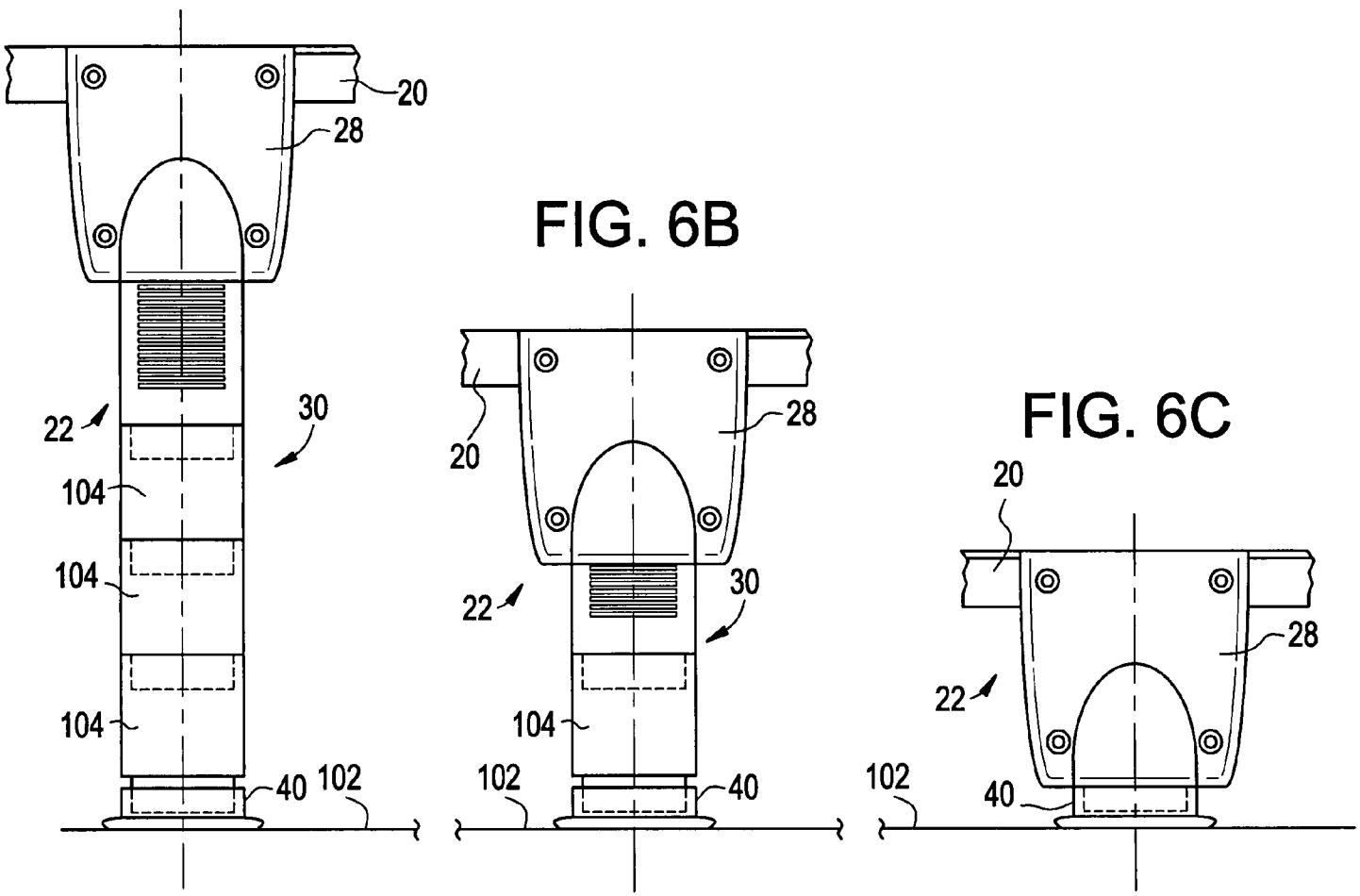
FIGS. 6A, 6B and 6C are side views of the leg assembly of FIG. 2 showing different height adjustments.

Next, with reference to FIGS. 6A, 6B and 6C, there is shown a series of views of the leg assembly 22 with the housing 28 affixed to a support member 20 with the leg 30 extending downwardly from the housing 28 to contact the floor 102 in supporting the support member 20. As shown, the height of the support member 20 in FIG. 6A can be about 18.5 inches above the floor 102 while the height of the support member 20 above the floor 102 in FIG. 6C can be about 6.0 inches. The difference in heights of the leg 30 is dependant upon the number of intermediate leg sections that are interposed between the bottom leg section 40 and the upper leg section 74. In FIG. 6A, there are three of such leg sections 104; in FIG. 6B, there is only one leg section 104 and in FIG. 6C, there are no leg sections such that the bottom leg section 40 is affixed in the aforedescribed manner to the housing 28.

Figure 7A:
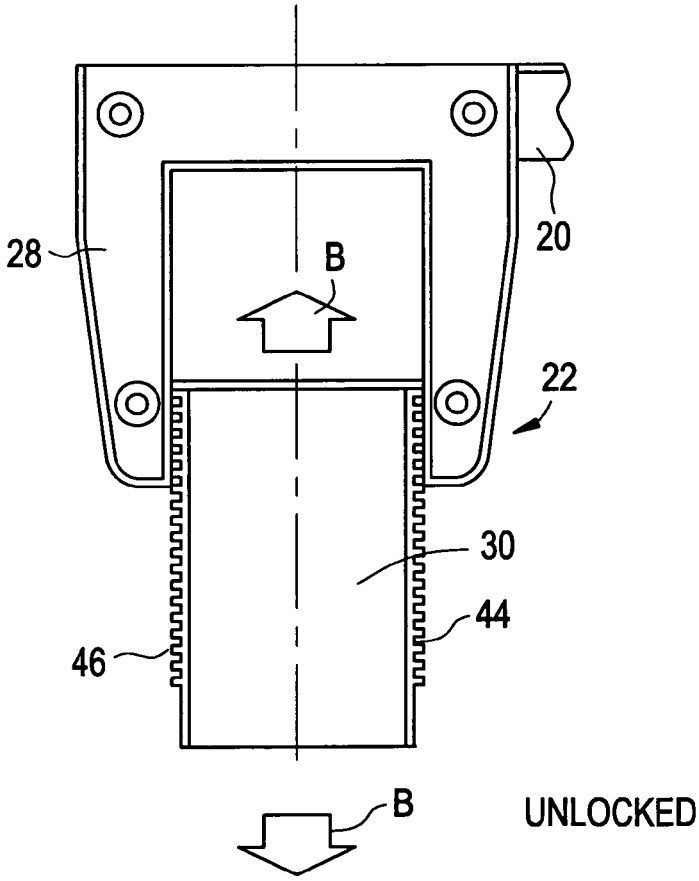
FIGS. 7A and 7B are side and end views, respectively, of the leg assembly showing its unlocked position.
Figure 7B:
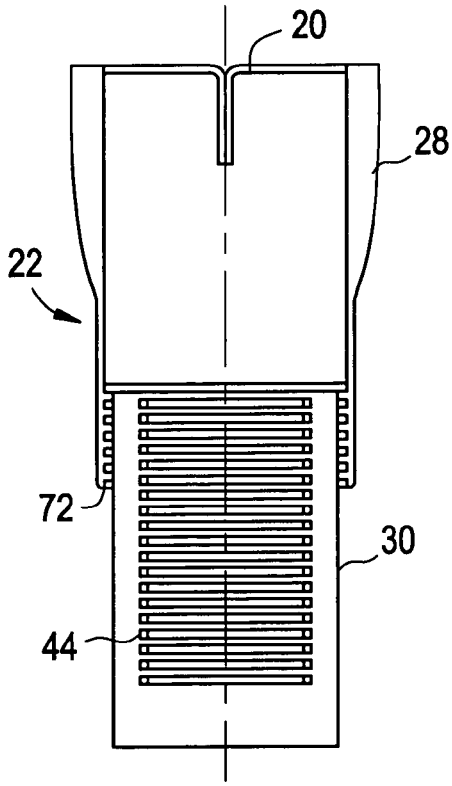

Turning next to FIGS. 7A and 7B, there is shown a front view and a side view of the leg assembly 22 with the leg 30 in its unlocked position. In this position, the centers of the grooves 44, 46 are aligned generally parallel to the longitudinal axis of the support member 20 and are not meshing with the grooves 72 in the housing 28 so that the leg is free to move vertically as shown by the arrows B so as to extend the leg 30 to the desired length in contact with the floor. Also, as an indication that the leg 30 is in its unlocked position the oblong glide 42 (FIG. 3) has its major axis at a right angle to the longitudinal axis of the support member 20 so that the user can easily verify that the leg 30 is in that unlocked position.

Figure 8A:
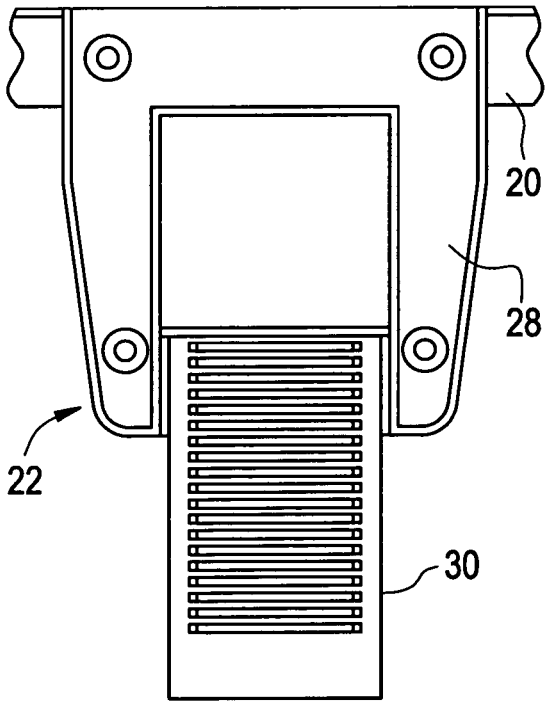
FIGS. 8A and 8B are side and end views, respectively, of the leg assembly showing its locked position.
Figure 8B:
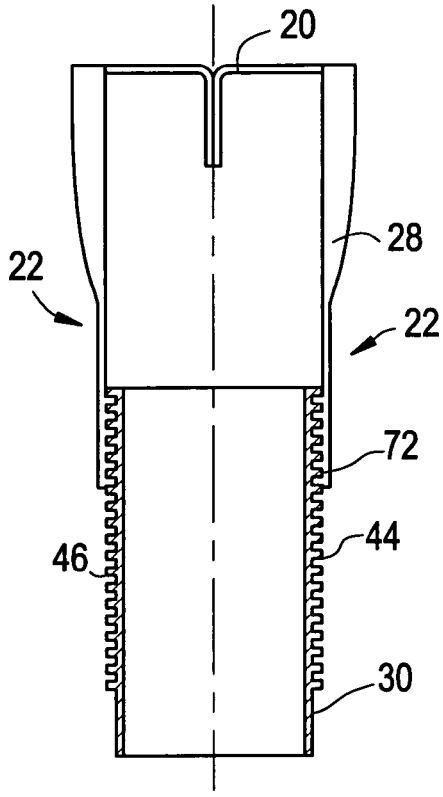

In FIGS. 8A and 8B, there is shown a front view and a side view of the leg assembly 22 with the leg 30 in its locked position, having been rotated a quarter of a turn, or about 90 degrees, from the unlocked position of FIGS. 7A and 7B. In this position, the centers of the grooves 44, 46 are generally at a right angle with respect to the longitudinal axis of the support member 20 and are meshed with the grooves 72 in the housing 28 so that the leg is prevented from moving vertically and the leg 30 is locked into the position shown and is in contact with the floor to support the support member 20. Again, as an indication that the leg 30 is in its unlocked position the oblong glide 42 (FIG. 3) has its major axis generally parallel to the longitudinal axis of the support member 20 so that the user can easily verify that the leg 30 is in that locked position.

Figure 9:
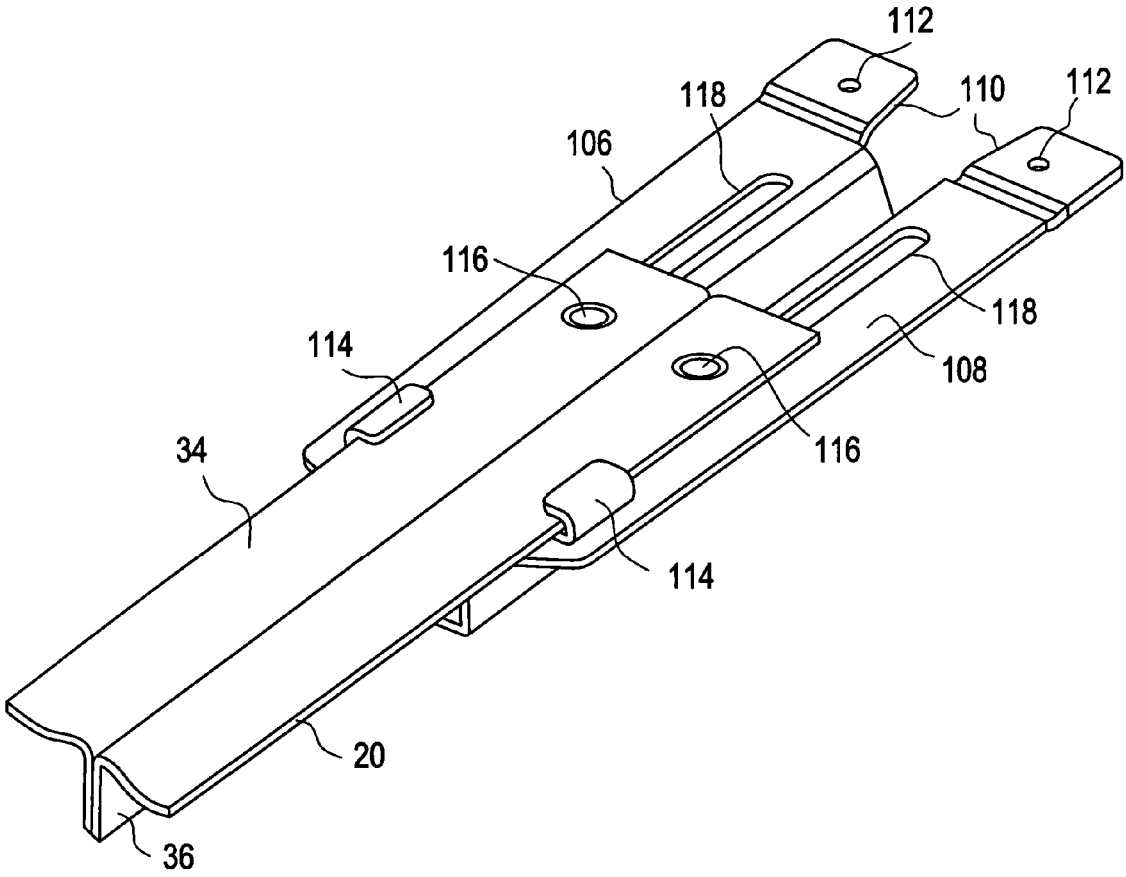
FIG. 9 is a perspective view of a telescoping bracket used with the present invention.

Turning now to FIG. 9, there is shown a perspective view of a telescoping bracket 106 that can be used with the particular cross sectional configuration of support member 20 in order to secure the support member 20 to the side rails 16, 18 as shown in FIG. 1. As can be seen, the support member 20 has its flat upper surface 34 and vertical flange 36 extending downwardly therefrom and the telescoping bracket 106 comprises a bracket body 108 that is slidingly affixed to the support member 20 along the longitudinal axis thereof so as to be movable toward and away from the side rails 16, 18 (FIG. 1) in order to adjust the length of the support member 20 to account for differently dimensioned spaces between those side rails 16, 18.

Thus, at the distal end 110 of the bracket body 108 there are holes 112 to accommodate screws to affix the telescoping bracket 106 to the wooden side rails 16, 18. The sliding affixation is provided by a pair of tabs 114 that are formed in the bracket body 108 and which overlap both ends of the flat upper surface 34 of the support member 20 and a pair of standoff rivets 116 that pass through slots 118 formed in the bracket body 108. Accordingly, the telescoping bracket 106 is free to slide along the support member 20 in order to be affixed to the side rails 16, 18.

Figure 10:
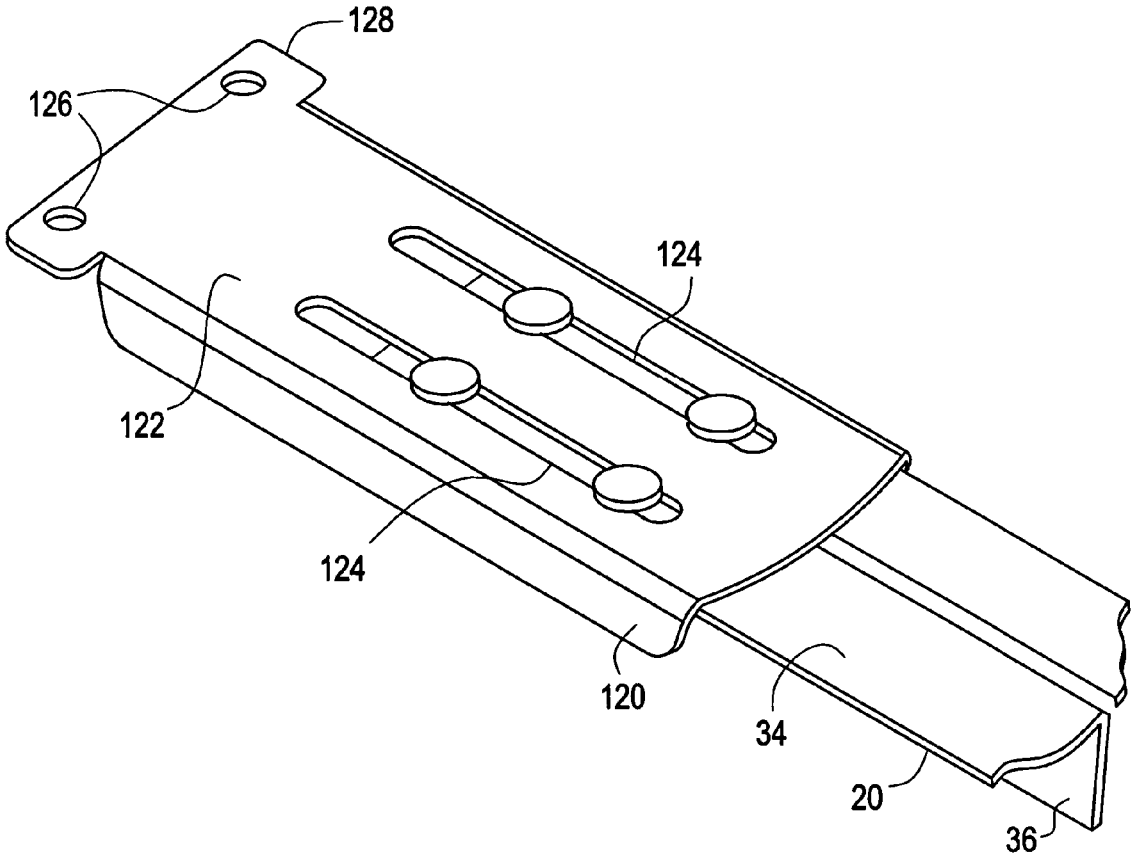
FIG. 10 is a perspective view of an alternative telescoping bracket used with the present invention.

Turning finally to FIG. 10, there is an alternative telescoping bracket 120 that has its bracket body 122 lying atop of the support member 20 and having a pair of slots 124 formed therein, again along the longitudinal axis of the support member 20. The holes 126 at the distal end 128 provide for screws to pass therethrough in order to affix the distal end 128 of the telescoping bracket 120 to the wooden side rails 16, 18 (FIG. 1).

While the present invention has been set forth in terms of a specific embodiment of embodiments, it will be understood that the present support member herein disclosed may be modified or altered by those skilled in the art to other configurations. Accordingly, the invention is to be broadly construed and limited only by the scope and spirit of the claims appended hereto.

We claim:

1. A support member adapted to join two parallel sides of a bed frame, said support member comprising a substantially straight member having a T-shaped cross section and having ends, said substantially straight member oriented between the parallel sides of the bed frame with a flat upper surface for supporting the weight of a mattress set and a vertical flange perpendicular to the flat upper surface and descending from a mid-point on the bottom of the flat upper surface, at least one telescoping bracket extending outwardly from at least one of said ends of said substantially straight member to affix said substantially straight member to at least one of the parallel sides of a bed frame, a leg assembly mounted to said substantially straight member and located about midway between the ends of said substantially straight member to rigidly contact a floor to support the substantially straight member, said T-shaped cross section of said substantially straight member providing inherent resistance to twisting and bowing under load and said mounting of said leg assembly to said substantially straight member being resistant to twisting when said leg assembly is moved across the floor while in contact with the floor.

2. The support member as defined in claim 1 wherein said substantially straight member is made from two opposing angle irons.

3. The support member as defined in claim 1 wherein said leg assembly comprises a molded plastic housing having a leg extending a length downwardly therefrom.

4. The support member as defined in claim 3 wherein the length said leg extends from said housing is adjustable.

5. A support member as defined in claim 1 wherein said at least one telescoping bracket is formed to retain the support member in a receptacle formed in the at least one parallel side of a bed frame.

6. A bed frame for underlying and supporting a box spring, said bed frame comprising a pair of side rails spaced apart and parallel to each other, a cross member affixed to each of said side rails and extending transversely therebetween, said cross member comprising a straight member having opposed ends, end brackets slidingly attached to said opposed ends of said straight member, said straight member having a generally T shaped cross section, said straight member at least one telescoping bracket extending outwardly from at least one of said ends of said straight member to affix said straight member to at least one of the parallel side rails of the bed frame.

7. A bed frame for underlying and supporting a box spring as defined in claim 6 wherein said cross member is made from two opposing angle irons joined together.

8. A bed frame for underlying and supporting a box spring as defined in claim 6 wherein said end brackets have flattened, flared ends affixed to said side rails.

9. A bed frame for underlying and supporting a box spring, said bed frame comprising a pair of side rails spaced apart and parallel to each other, a cross member affixed to each of said side rails and extending transversely therebetween, said cross member comprising a straight member having opposed ends, end brackets slidingly attached to said opposed ends of said straight member, said straight member having a generally T shaped cross section, wherein said bed frame is located on a floor and wherein said cross member includes a plastic leg housing located generally midway between the side rails and a leg adjustably mounted to said plastic leg housing in a rigid fashion to support a load on said straight member by contact with the floor.

10. A bed frame for underlying and supporting a box spring as defined in claim 9 wherein said leg comprises a cylindrical part that is attached in a telescoping manner to the plastic leg housing to form a desired range of heights from said straight member to the floor.

11. A bed frame for underlying and supporting a box spring as defined in claim 10 wherein said leg comprises a plurality of cylindrical parts that releasably attach together in a telescoping manner to form a desired range of heights from the straight member to the floor.

12. A bed frame for underlying and supporting a box spring as defined in claim 11 wherein said plastic leg housing and said leg include a plurality of corresponding outstanding grooves located in a pattern covering only a portion of the entire contact surface of said leg and said plastic housing.

13. A bed frame for underlying and supporting a box spring as defined in claim 12 wherein said leg is adjustable with respect to said plastic leg housing by moving out of alignment the corresponding outstanding groves formed on the plastic leg housing and the leg.

14. A bed frame for underlying and supporting a box spring as defined in claim 13 wherein said outstanding grooves are parallel and circumvent about ½ of the exterior circumference of the leg and interior of the plastic leg housing.

15. A bed frame for underlying and supporting a box spring as defined in claim 14 wherein said grooves are divided into two corresponding areas of the leg and plastic leg housing each of the circumference of circles.

16. A cross member for use with a bed frame, said cross member comprising a straight member constructed of steel with a generally T shaped cross section and having a center located about midway between two opposing ends, a molded plastic housing contacting said straight member at about said center of said straight member, said molded plastic housing having a leg extending a length from said molded plastic housing, the length of said leg being adjustable by a locking mechanism manually operable by a use to allow the leg to be released from a locked position to an unlocked position to allow said leg to drop downwardly by gravity and wherein said two opposing ends of said straight member include slides adapted to be slidably affixed to said opposing ends to enable the overall length of said straight member to be adjusted.

17. A cross member for use with a bed frame as defined in claim 16 wherein said cross member is made from two opposing angle irons.

18. A cross member for use with a bed frame as defined in claim 16 wherein said slides are stamped metal slides.

19. A locking system for adjusting the length of a leg with respect to a cross member of a bed assembly, said system comprising a housing affixed to said cross member, said housing having interior grooves, a leg having exterior grooves corresponding to said housing interior grooves, said leg having a locked position wherein said leg is fixed with respect to said housing wherein the corresponding grooves on the housing and the leg interlock, and an unlocked position wherein said leg is slidably within said housing, said leg being rotatable in relation to the housing to move between said locked and said unlocked positions.

20. A locking system as defined in claim 19 wherein the leg is rotatable about one quarter of a complete turn to move between said locked and said unlocked positions.

21. A locking system as defined in claim 20 wherein said locking system includes a latch having a stop so as to curtail the rotation of said leg to the about one quarter turn and to provide an indication when the leg is in said locked or unlocked position.

22. A locking system as defined in claim 19 wherein said leg is adapted to slide downwardly from said housing when said leg is in said unlocked position.

23. A locking system as defined in claim 22 wherein said system includes a plurality of leg parts removably attached together to increase the range of different lengths.

24. A locking system as defined in claim 19 wherein the leg has a glide located at a lower end thereof having an oblong configuration and wherein the major axis of the oblong glide is at a right angle to the cross member when the leg is in its locked position.

25. A leg assembly for providing support to a structure, said leg assembly comprising a housing having a bracket adapted to be affixed to the structure, said housing having a leg slidably affixed thereto, a locking means adapted to lock said leg in a locked position with respect to said housing, said locking mechanism having a latch formed by opposing interlocking outstanding groves in said housing and said leg adapted to be operated by a user to move said leg between said locked position and said unlocked position.

26. A leg assembly as defined in claim 25 wherein said latch is engaged by the user by turning the leg to retain said leg in said locked position.

27. A leg assembly as defined in claim 25 wherein said leg is adapted to slide downwardly from said housing when said leg is in said unlocked position.

28. A leg assembly as defined in claim 25 wherein said structure is a wooden bed slat and said bracket is adapted to be affixed to said wooden slat by means of screws.

29. A leg assembly as defined in claim 25 wherein said structure is a metal bed cross member.

30. A leg assembly as defined in claim 25 wherein the structure is a bed frame having spaced apart, parallel sides and said leg has a glide located at a lower end thereof having an oblong configuration, and wherein the major axis of the oblong glide is parallel to the said sides when the leg is in its locked position.

* * * * *